United States Patent [19]

Smith

[11] Patent Number: 4,589,327

[45] Date of Patent: May 20, 1986

[54] FIRING LOCK WITH SAFETY SYSTEM FOR SELF LOADING FIRE ARMS

[76] Inventor: David E. Smith, 5 Park Ave., Telscombe Cliffs, Sussex, England

[21] Appl. No.: 593,389

[22] Filed: Mar. 26, 1984

[30] Foreign Application Priority Data

Mar. 28, 1983 [GB] United Kingdom ..... 8308438

[51] Int. Cl.[4] ..... F41C 3/00; F41C 17/04; F41C 19/00; F41D 11/02

[52] U.S. Cl. ..... 89/148; 89/138; 89/196; 42/70 F

[58] Field of Search ..... 89/148, 138, 196; 42/70 F

[56] References Cited

U.S. PATENT DOCUMENTS

| | | | |
|---|---|---|---|
| 1,376,165 | 4/1921 | Rosebush | 89/148 X |
| 1,896,820 | 2/1933 | Jolidon | 89/148 |
| 2,110,317 | 3/1938 | Altenburger | 89/148 |
| 2,140,946 | 12/1938 | Swartz | 89/148 |
| 2,846,925 | 8/1958 | Norman | 89/148 X |
| 4,090,316 | 5/1978 | Volkmar | 42/70 F |
| 4,208,947 | 6/1980 | Hillberg | 89/148 |
| 4,282,795 | 8/1981 | Beretta | 89/148 |
| 4,358,987 | 11/1982 | Wilhelm | 89/196 |

FOREIGN PATENT DOCUMENTS

| | | | |
|---|---|---|---|
| 1098413 | 1/1961 | Fed. Rep. of Germany | 89/148 |

*Primary Examiner*—David H. Brown

*Attorney, Agent, or Firm*—Harness, Dickey & Pierce

[57] ABSTRACT

A safety catch for a self-loading pistol type fire arm is provided with a safety catch comprising an arbor (HH) rotatable in the fire arm frame (A) by means of manual levers (HH2 and JJ2) mounted outside the frame on either side. From a rest or off position, in which the fire arm can be fired, the arbor can be rotated upwardly to an end position in which means on the arbor engage the hammer (J) when it is in either the cocked or uncocked position, to lock it against rotation and thus prevent the pistol being fired. Additionally, when the hammer is cocked, the arbor can be rotated in the opposite direction, in which case it causes rotation of a detent member (LL) which lifts the ejector (L) to engage and hold the firing pin and to retract the end (S2) of the firing pin (S) struck by the hammer (J) within the slide (B) and thereafter to trip the sear (K) to release the hammer (J) safely from the cocked to the uncocked position.

10 Claims, 64 Drawing Figures

J6
B3
S1
LL
EE
HH7
KK
5
TT
SS
A21
T
BB1
BB2
GG
FF
K
H4
H2
L
N
B
S
F
MM
M
4
3
2
1
XX
XX1
C1
C
E
E1
D
Y1
D8
Z2
Z1
H5
DD
G
G1
A10
VV1
T1
VV
UU
A
AA
B13
S2
BB6
L9
H1

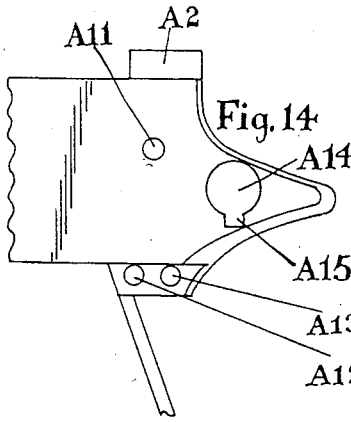
Fig. 14
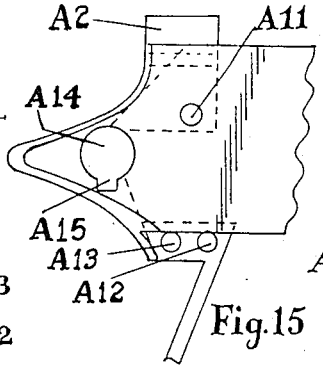
Fig. 15
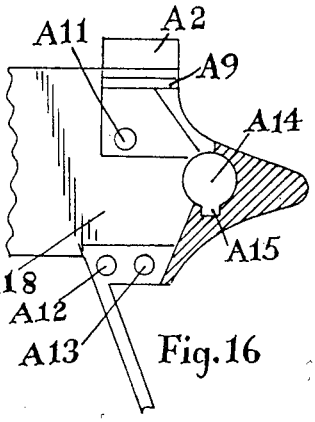
Fig. 16
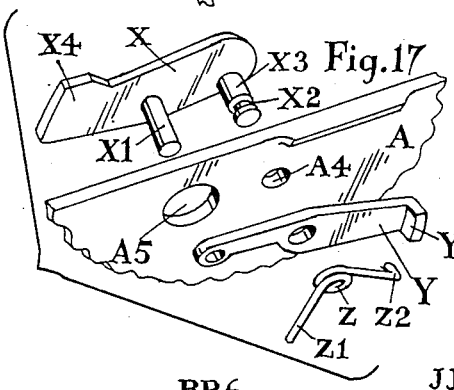
Fig. 17
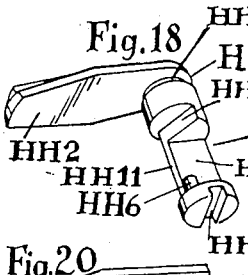
Fig. 18
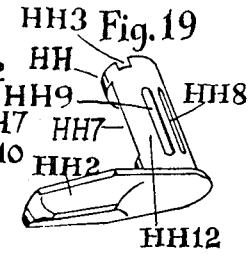
Fig. 19
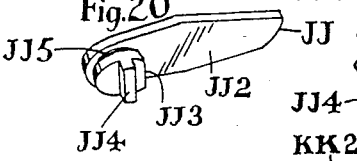
Fig. 20
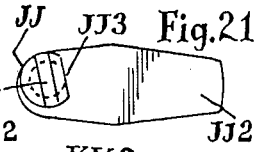
Fig. 21
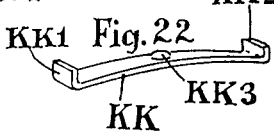
Fig. 22
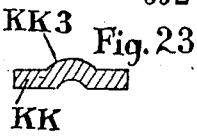
Fig. 23
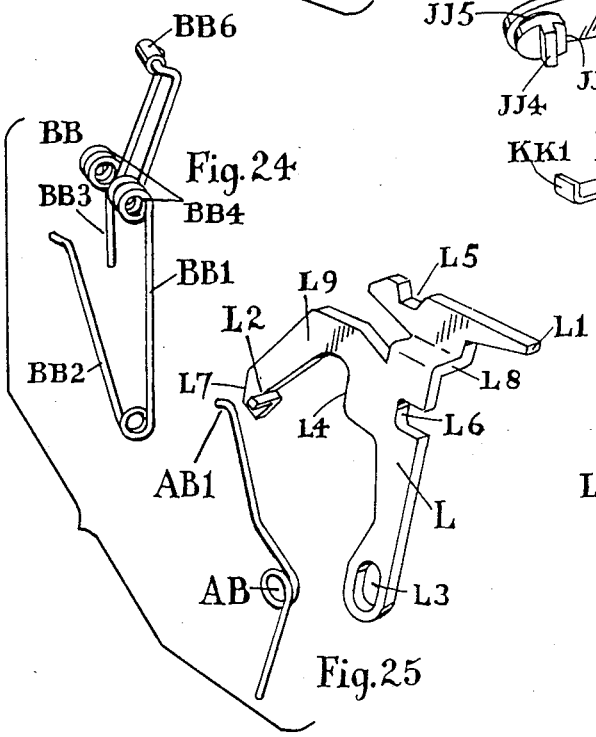
Fig. 24
Fig. 25
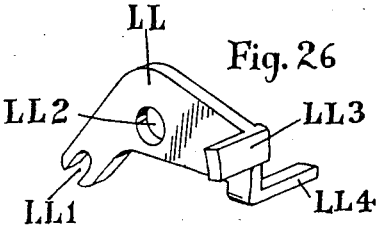
Fig. 26

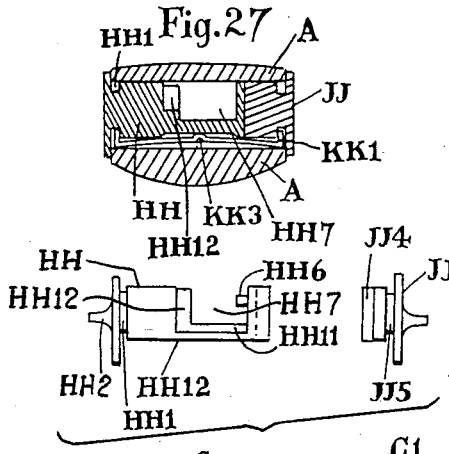
Fig. 27
Fig. 28
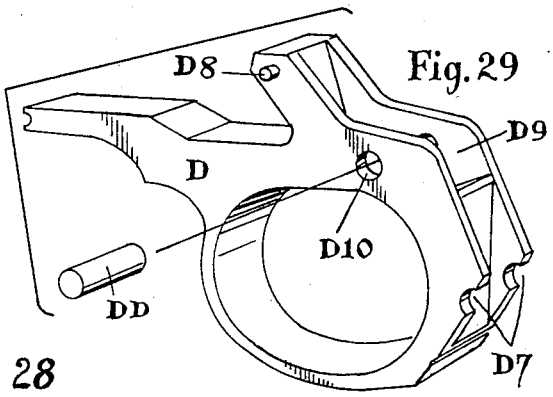
Fig. 29
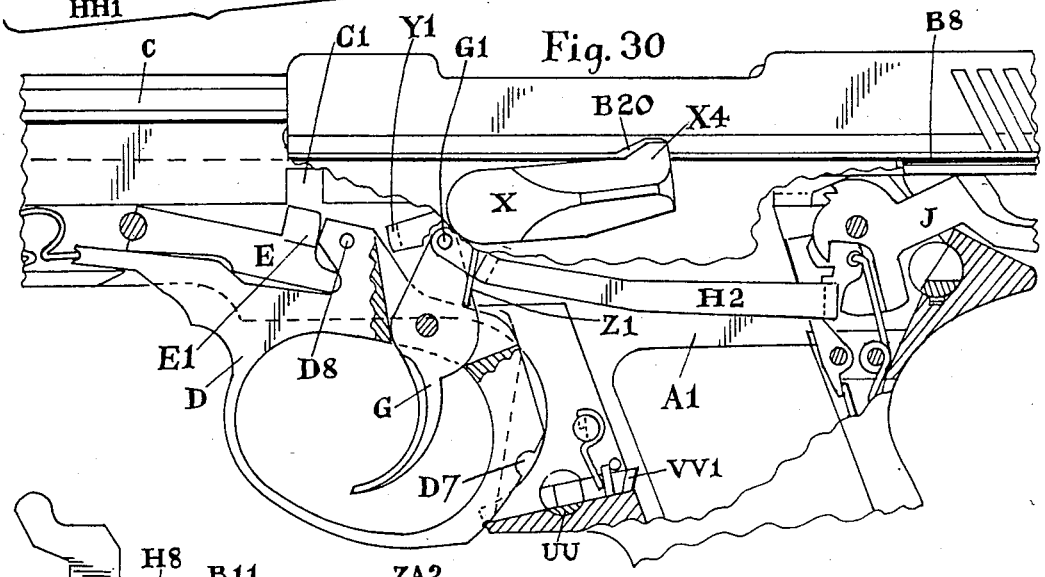
Fig. 30
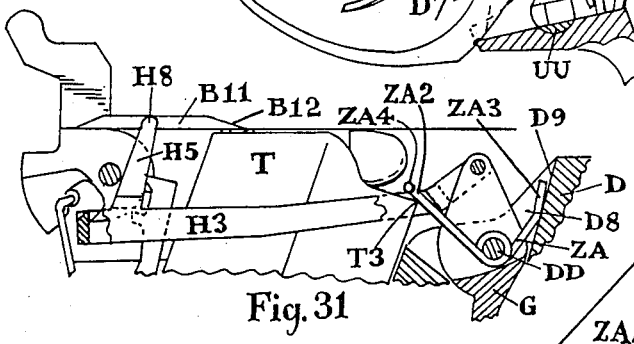
Fig. 31
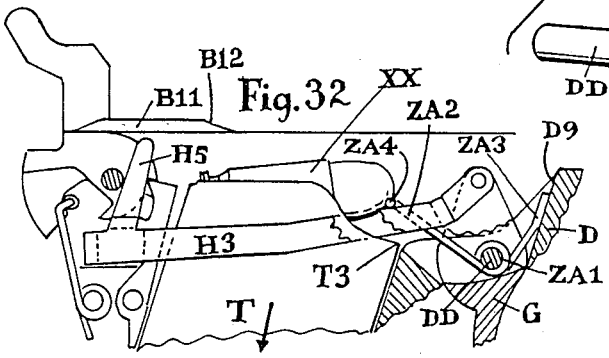
Fig. 32
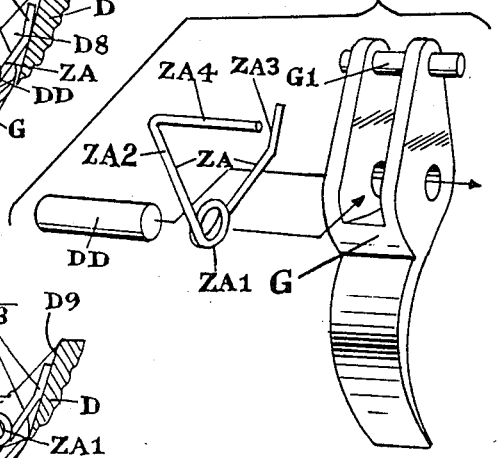
Fig. 33

Fig. 41
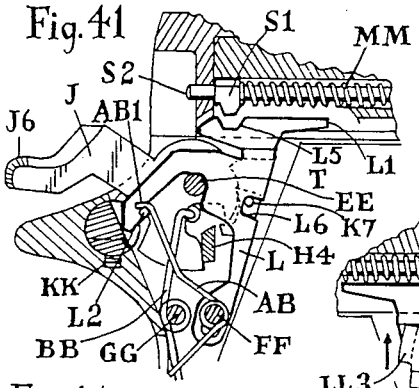
Fig. 42
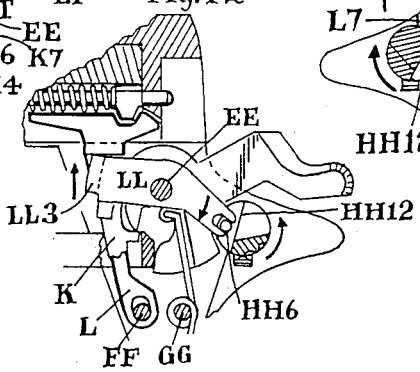
Fig. 43
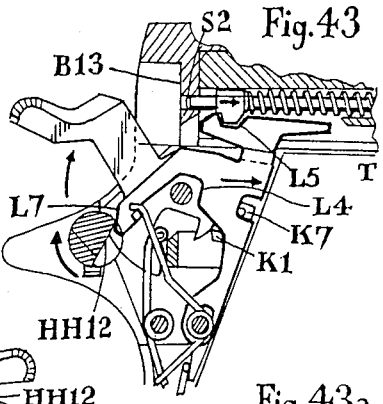
Fig. 41a
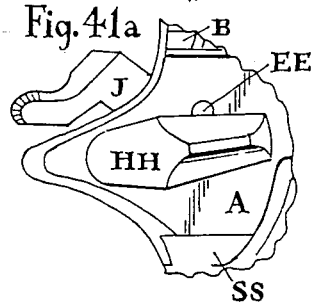
Fig. 42a
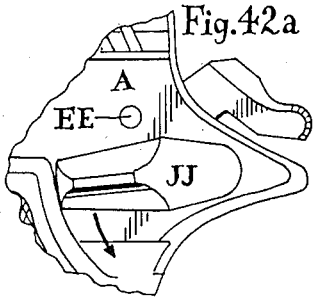
Fig. 43a
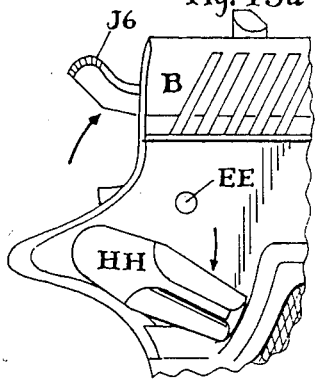
Fig. 44
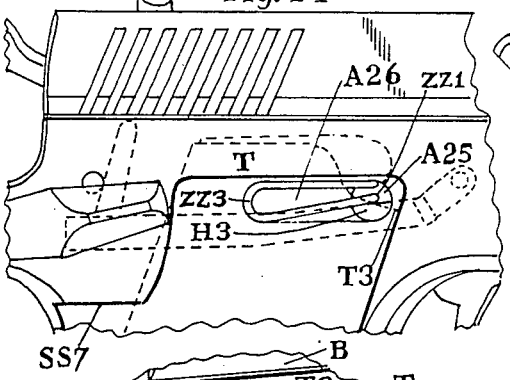
Fig. 45
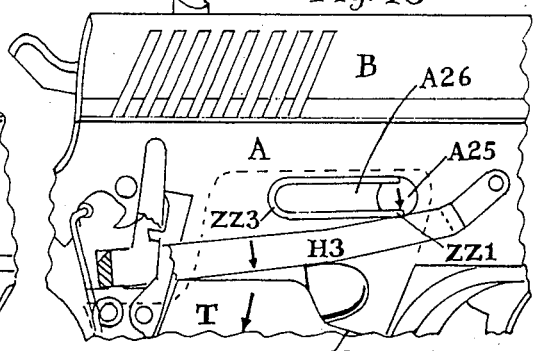
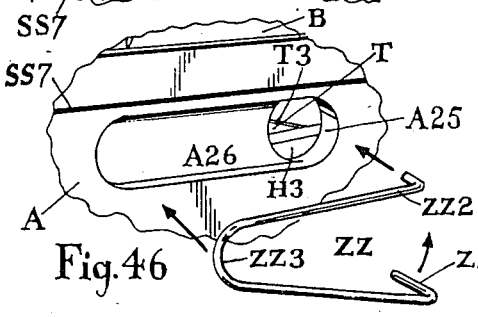
Fig. 46
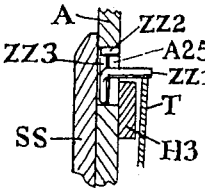
Fig. 47
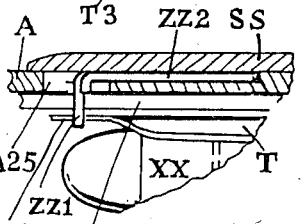
Fig. 48

Fig.49
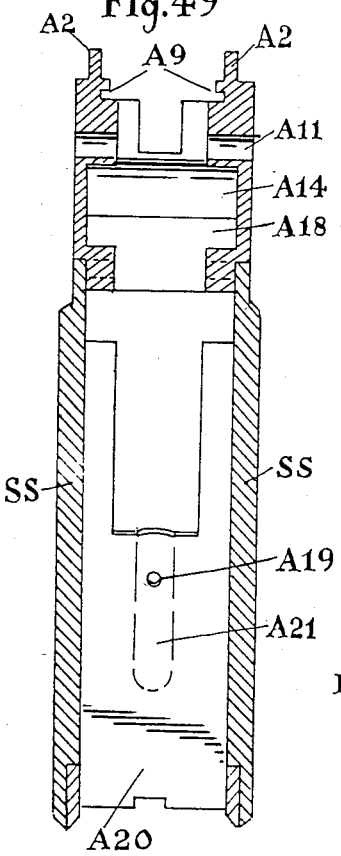
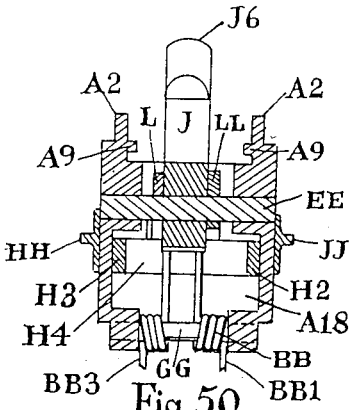
Fig.50
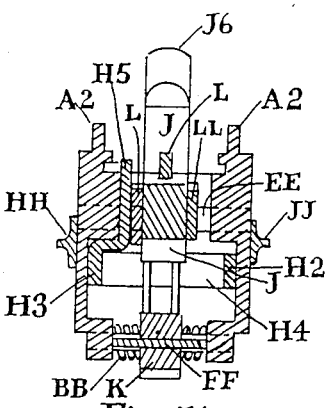
Fig. 51
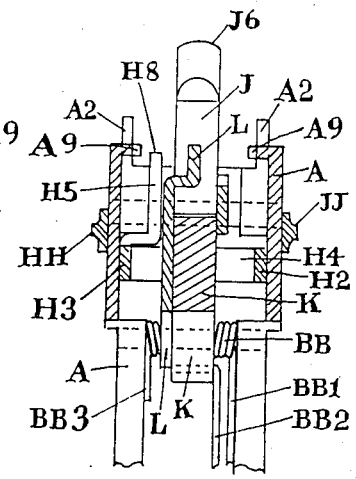
Fig.52
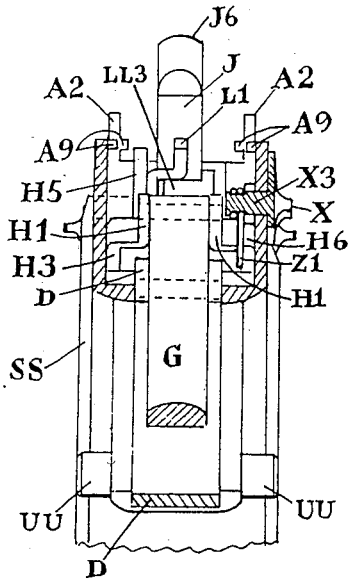
Fig.53

FIRING LOCK WITH SAFETY SYSTEM FOR SELF LOADING FIRE ARMS

This invention relates to fire arms of the self loading pistol type, having a reciprocating slide carrying an inertia-operated firing pin, the firing lock comprising a hammer, sear, trigger, trigger bar, ejector and main spring and a safety catch.

It is an object of the present invention to provide such a fire arm with a safety catch which renders the firing lock operable and inoperable when desired by the user, and also allows the user to release the hammer from a cocked position to an uncocked position, with a cartridge chambered, with no danger of discharging the cartridge.

It is a further object of the invention to provide for self loading pistols or other fire arms a firing lock with a safety system not requiring specialised tools to disassemble.

It is another object of the invention to provide for self loading pistols or fire arms a firing lock with safety system of simple construction and cheap to manufacture.

It is another object of the invention to provide for self loading pistols or fire arms a magazine safety system of simple construction that is easily removed or fitted.

According to the invention, there is provided a fire arm of the self loading pistol type having a reciprocating slide carrying an inertia-operated firing pin, a firing lock comprising a hammer, sear, trigger, trigger bar, ejector and main spring, and a safety catch comprising an arbor rotatably mounted in the frame of the fire arm, and manual lever means located on the outside of the frame for rotating said arbor in either direction from a rest or off position in which the fire arm can be operated, said arbor being rotatable in one direction to an end position in which the hammer in either the cocked or uncocked position is locked against rotation by respective engagement means on the arbor, and said arbor also being rotatable in the other direction to move a detent member pivotally mounted in said frame to move the ejector upwardly and forwardly to engage said firing pin and to withdraw its striking end, against which the hammer strikes in operation of the fire arm, completely into the slide, and thereafter to release the hammer from cocking engagement with said sear, whereby said hammer is returned to the uncocked position without danger of discharging a live cartridge in the breech of the fire arm.

Preferably, during movement of the arbor to the end position in which the hammer is locked against rotation, the detent is rotated by the arbor to depress and hold the trigger bar in a position in which movement of the trigger will not move the sear to release the hammer.

The arbor may be formed in two parts, each having a respective manual lever at one end thereof, said parts being connected together at their ends remote from said levers by at least one projection on one said part engaging at least one corresponding recess in the other said part and spring loaded towards one another. The spring loading may be provided by a spring located in a recess in the frame below said arbor and having upstanding ends engaging in respective peripheral grooves in said two parts of the arbor. The spring preferably has a central protuberance adapted to resiliently engage in a respective longitudinal groove in said arbor when said safety catch is in the rest or said one end position.

The main spring of the firing lock may be formed as a single unit from spring wire having a central coiled portion for mounting on a pivot pin in the frame, any upper limb portion bearing against the hammer and urging it to rotate towards said firing pin, and a lower limb portion bearing against the sear to urge the sear nose to bear against the hammer.

Embodiments of the invention are shown in the drawings and will be described in greater detail hereinafter. The same letters of reference indicate corresponding parts in the several figures of the drawings.

FIG. 1 of the accompanying drawings represents, partly in elevation and partly in longitudinal vertical section, a self loading semi-automatic pistol provided with means constructed and arranged in accordance with this invention for a firing lock with single action and double action functions, with safety system provided partly by a sear notch in the hammer, a hammer block and trigger bar disconnector provided by dual levers at the rear of the frame, a firing pin retraction and locking system provided by movement of the ejector in conjunction with the operation of the safety catch, and an easily detachable safety system which renders the firing lock inoperable when the magazine is removed partly or wholly from the pistol; this view shows the pistol with loaded chamber, loaded magazine inserted, and firing lock at rest, hammer uncocked, safety not applied FIG. 2 is a partial view of the pistol, partly in elevation and partly in longitudinal vertical section, showing the hammer cocked and gun ready to fire;

Figures 1, 2:
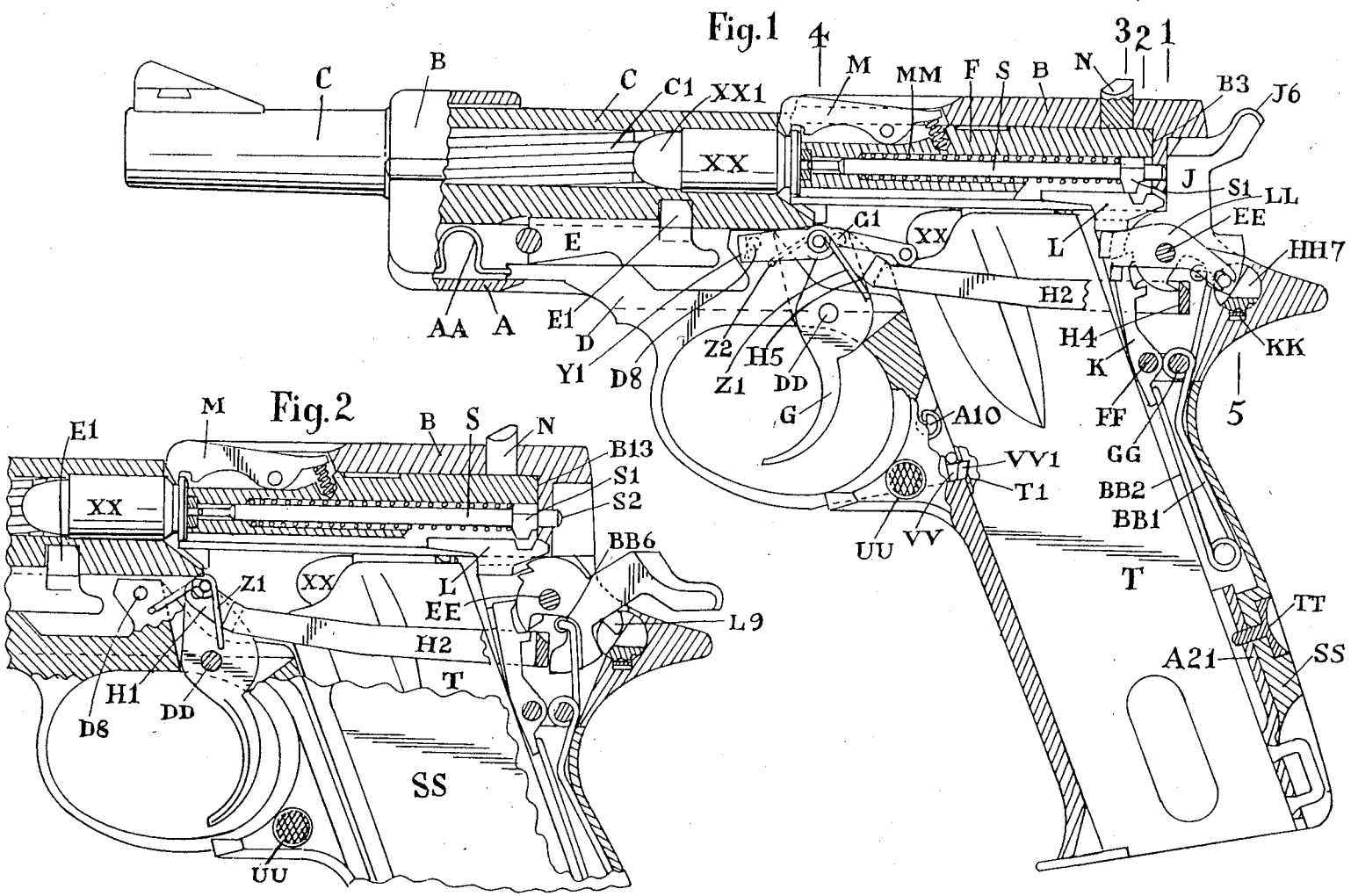
Figures 6A, 6B, 6C, 6D, 7A, 7B, 7C, 7D, 8A, 8B, 8C, 9:
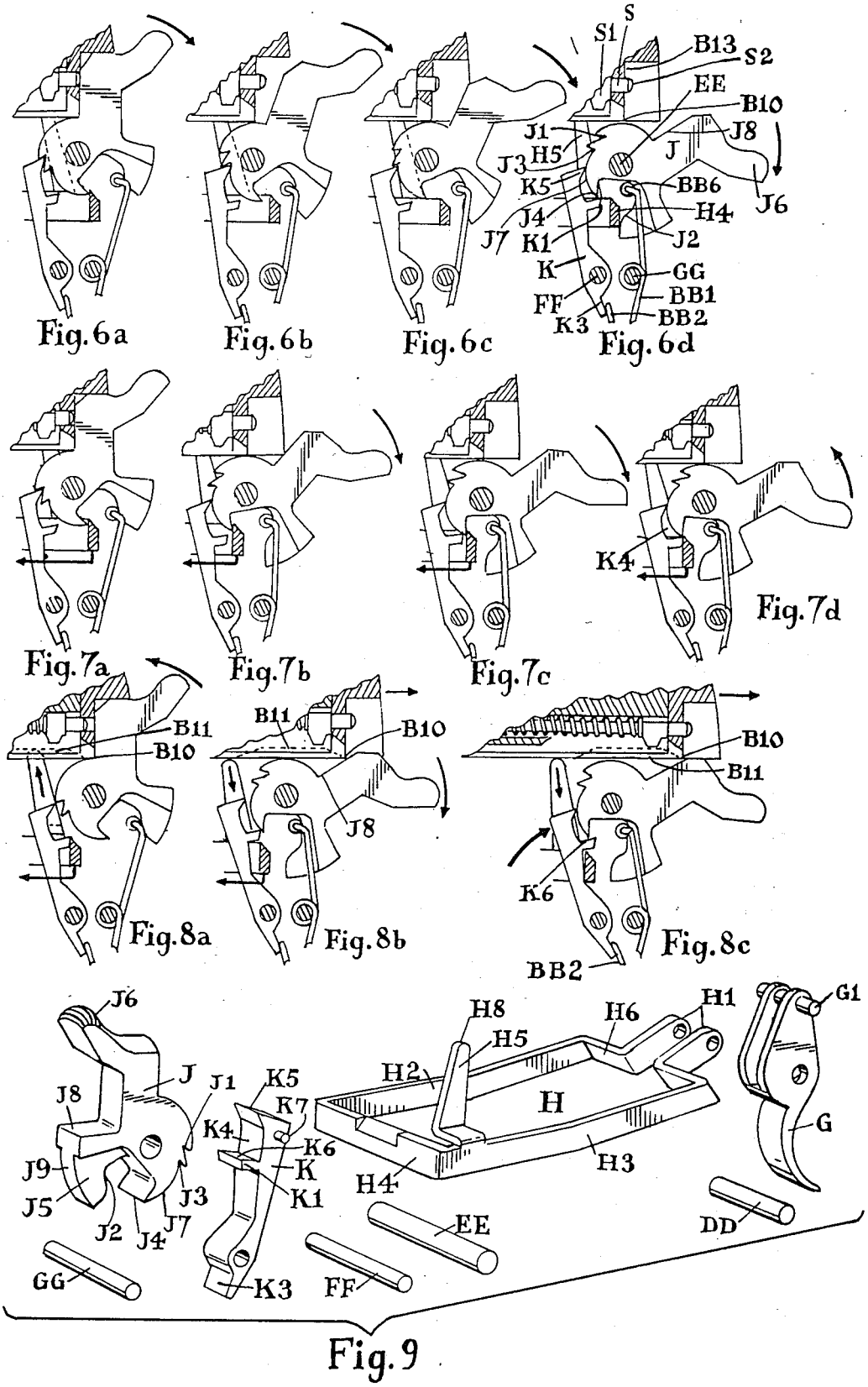
Figure 10:
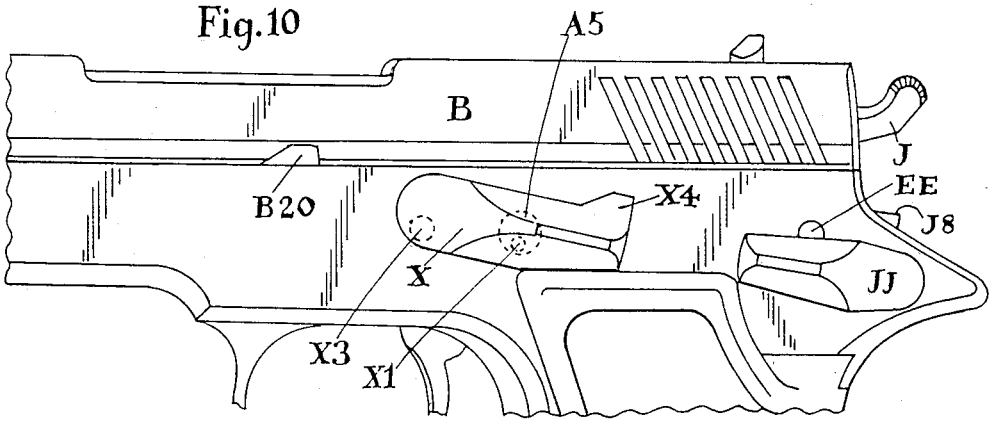
Figure 11:
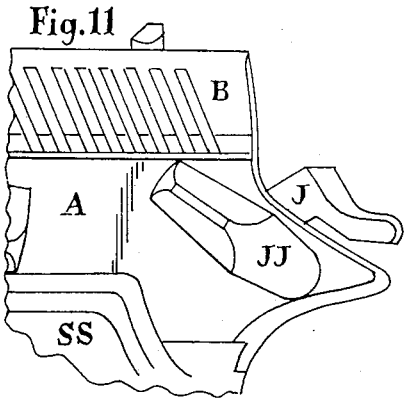
Figure 12:
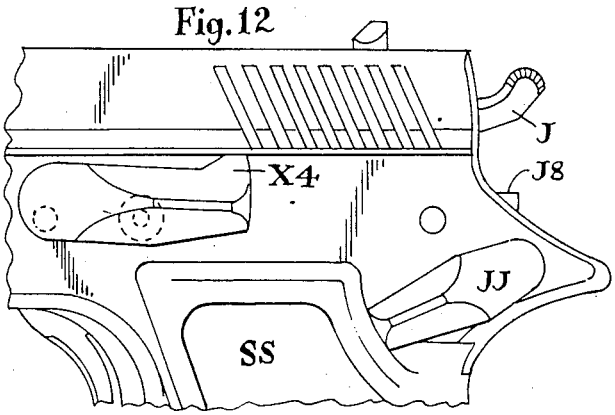
Figure 13:
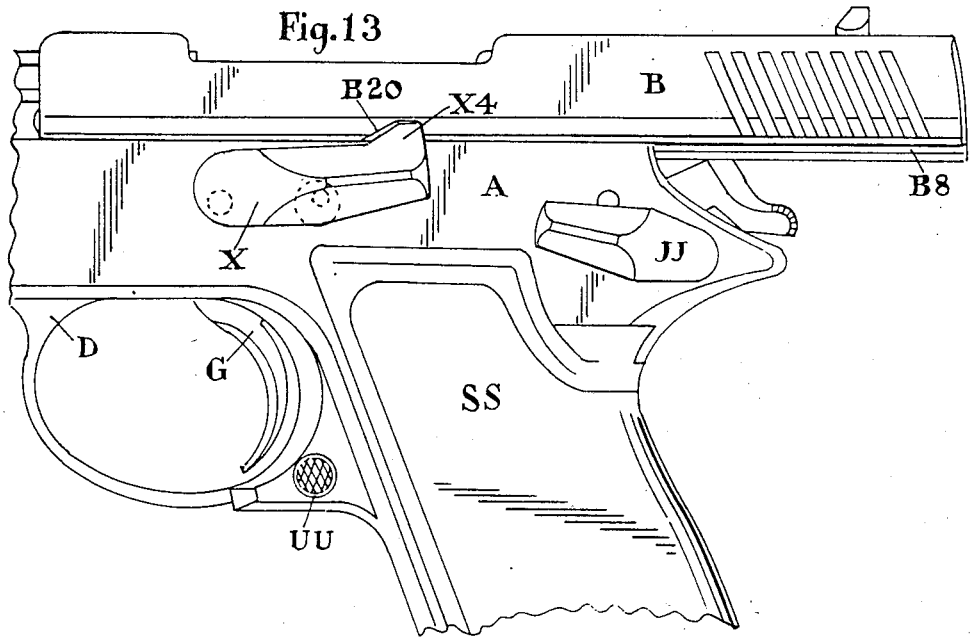
Figure 34:
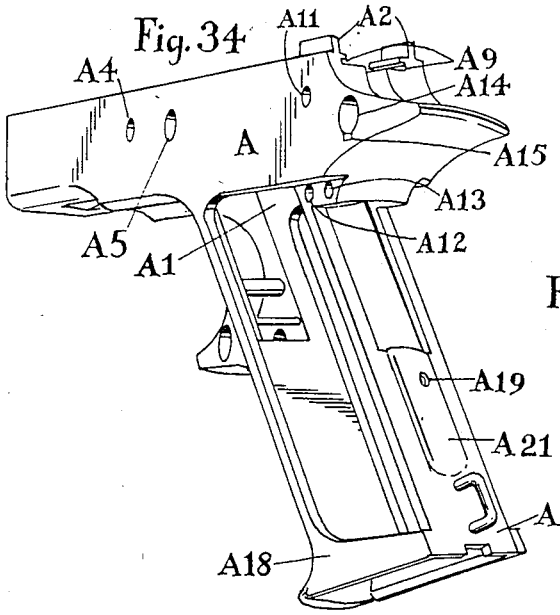
Figure 36:
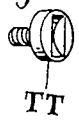
Figure 35:
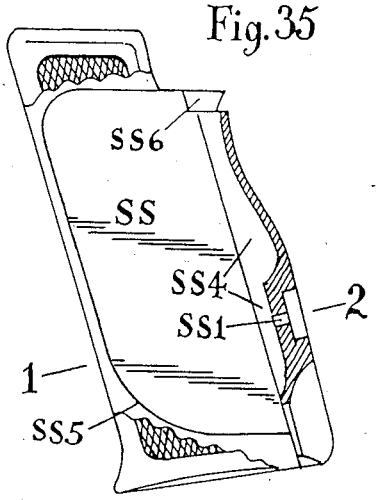
Figure 37:
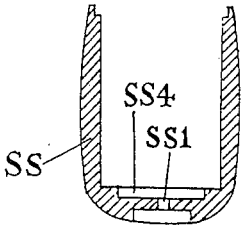
Figure 38:
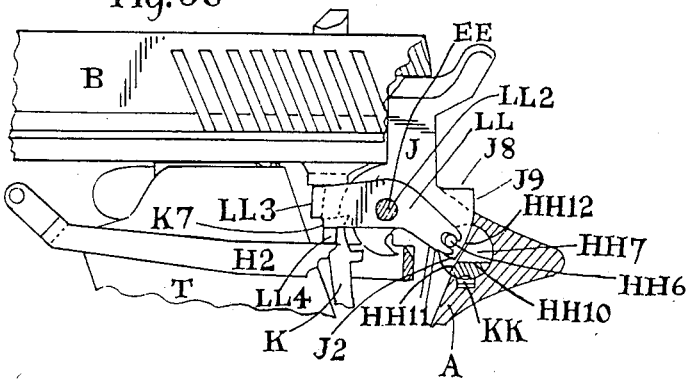
Figure 39:
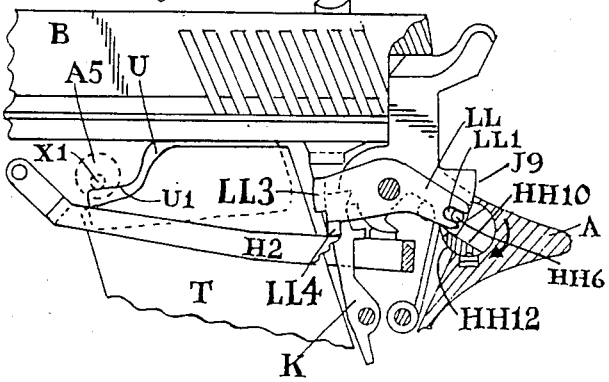
Figure 40:
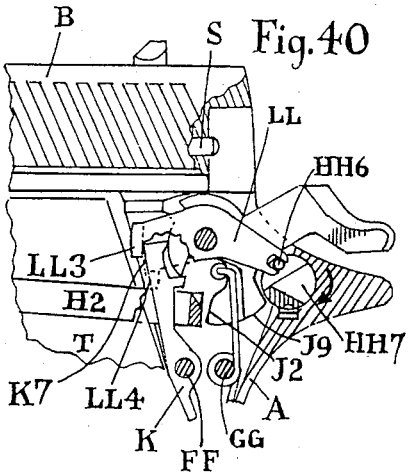

FIGS. 6*a* through 6*d* are is a series of four views of the firing lock rear section showing the sequence during manual cocking of the hammer, this method used for single action firing;

FIGS. 7*a* through 7*d* are is a series of four views of the firing lock rear section showing the operation during the double action sequence, trigger operation drawing the trigger bar forward, thereby pivoting the hammer;

FIGS. 8*a* through 8*c* are is a series of three views of the firing lock rear section showing the action of the slide after firing, rotating the hammer, and the disconnection sequence of the trigger bar, and reengagement of the sear to hammer;

FIG. 9 is an exploded perspective view of the main firing lock items, with hammer, sear, trigger bar, trigger, and main spring, sear, hammer and trigger pivot pins;

FIG. 10 is a partial left side elevation of the pistol, with a loaded chamber indicated, loaded magazine indicated by the hold open catch, and the safety catch in the disengaged position;

FIG. 11 is a left side elevation of the pistol rear upper section, showing the safety catch engaged with the hammer cocked;

FIG. 12 is a partial left side elevation of the pistol showing the hold open catch indicating an empty magazine in the pistol and the safety catch levers depressed fully thereby dropping the hammer to the uncocked position safely;

FIG. 13 is a partial left side elevation of the pistol with the slide held locked to the rear by the holdopen catch;

FIG. 14 is a left side elevation of the rear upper frame;

FIG. 15 is a right side elevation of the rear upper frame with dotted lines to show the interior structure to coincide with FIG. 16;

FIG. 16 is a longitudinal vertical section along the centre line of the rear upper frame;

FIG. 17 is a perspective view of holdopen catch assembly in relation to its accommodation in the frame;

FIG. 18 is a perspective view of the right safety lever unit viewed from above;

FIG. 19 is a perspective view of the right safety lever unit viewed from below;

FIG. 20 is a perspective view of the left safety lever unit viewed from above;

FIG. 21 is a right side elevation of the left safety lever unit;

FIG. 22 is a perspective view of the safety catch spring;

FIG. 23 is a transverse section of the centre section of the safety catch spring;

FIG. 24 is a perspective view of the combination hammer and sear main spring;

FIG. 25 is a perspective view of the ejector unit and ejector spring;

FIG. 26 is a perspective view of the safety detent piece;

FIG. 27 is a transverse vertical section of the whole safety catch lever units assembled in the frame along line 5 in FIG. 1;

FIG. 28 is a front elevation of right and left safety lever units;

FIG. 29 is a perspective view of the trigger guard unit and trigger axis pin;

FIG. 30 is a partial view of the pistol, partly in side elevation and partly in longitudinal vertical section, showing forward depression of the trigger guard and locking block, to permit removal of the barrel and slide;

FIG. 31 is a partial view of the pistol, in longitudinal cutaway section, showing a magazine safety system, with magazine inserted, and trigger bar able to engage hammer bent or sear nose;

FIG. 32 is a partial view of the pistol, in longitudinal cutaway section, with the magazine partially removed and the freed magazine safety spring depressing the trigger bar;

FIG. 33 is a perspective view showing the trigger, trigger axis pin and magazine safety spring;

FIG. 34 is a perspective view of the pistol frame viewed from the rear;

FIG. 35 is a view of the grip unit, partly in left side elevation and partly in longitudinal vertical section;

FIG. 36 is a perspective view of the grip retaining screw;

FIG. 37 is a transverse longitudinal section of the grip along line 1 to 2 in FIG. 35;

FIG. 38 is a partial view of the pistol, partly in left side elevation, partly in longitudinal vertical section, with the hammer at rest, the manual safety not applied, as shown in FIG. 10;

FIG. 39 is a partial view of the pistol, partly in left side elevation, partly in longitudinal vertical section, with the manual safety applied as in FIG. 11, with hammer at rest;

FIG. 40 is a partial view of the pistol, partly in left side elevation, partly in longitudinal vertical section, with the manual safety applied as in FIG. 11, with hammer cocked;

FIGS. 41 and 41*a* are a partial sectional view and a partial side elevation, respectively, of the rear lockwork, right side, showing the position of the ejector unit, in bold outline, with the safety levers as in FIG. 41*a;*

FIGS. 42 and 42*a* are, respectively, a partial left side sectional view and a partial side elevation of the rear lockwork with the safety levers being depressed as in FIG. 42*a,* the ejector unit in bold outline, being raised by the safety detent piece;

FIGS. 43 and 43*a* are, respectively, a partial right side sectional view and a partial right side elevation of the rear lockwork with the safety levers fully depressed as in FIG. 43*a,* the ejector unit fully raised and forced forward, the hammer released and pivoting to the uncocked position;

FIG. 44 is a right side elevation of the pistol rear upper portion showing an alternative magazine safety system to that shown in FIGS. 31, 32, and 33. The pistol is shown with magazine inserted, the grip area being shown in bold outline;

FIG. 45 is a right side elevation of the pistol rear upper portion, in a partial schematic view, showing operation of the alternative magazine safety system, the grip area being in dotted outline;

FIG. 46 is a perspective view of the magazine safety system spring from FIG. 44, showing the frame cutout to accommodate same spring, the grip removed;

FIG. 47 is a transverse vertical section and schematic view of the magazine safety as in FIG. 44;

FIG. 48 is a longitudinal transverse section and schematic view of the magazine safety as in FIG. 44;

FIG. 49 is a transverse vertical section of the frame and grip without other fittings along line 1 in Figure;

FIG. 50 is a transverse vertical section of the frame with all relevant fittings but without grip, along line 1 in FIG. 1;

FIG. 51 is a transverse vertical section of the frame with all relevant fittings but without grip, along line 2 in FIG. 1;

FIG. 52 is a partial transverse vertical section of the frame with all relevant fittings but without grip along line 3 in FIG. 1; and FIG. 53 is a partial transverse vertical section of frame and trigger guard with relevant fittings, without magazine, along line 4 in FIG. 1.

In the self loading pistol represented, the slide B is mounted on Frame A by means of frame guide rails A9 (FIG. 49) engaging with slide grooves B8 (FIG. 13) and frame wings A2 (FIG. 49) act upon and compress recoil springs carried longitudinally in the slide. The rear of the slide holds a breech insert F which is retained by rear sight N. The breech insert holds the firing Pin S and firing pin spring MM, the firing pin and firing pin spring being prevented from escaping to the rear by a firing pin boss S1 seating against a solid surface B3 within the rear section of the slide. The forward frame accommodates a trigger guard D which is normally kept forced to the rear by trigger guard spring AA and the trigger guard locates against frame pin A10, in cut outs D7. The trigger guard has a cut out section D9 which carries in each side panel, a hole D10 into which the trigger pin DD passes transversely from either side.

Carried on the trigger pin is the trigger G which has a transverse pin G1 which protrudes from either side of the trigger upper section, onto which are sprung the two forward wings H1 of the trigger bar H. Two limbs H2 and H3 of the trigger bar pass longitudinally to the rear inside the frame sides and pass across the magazine well A1. The magazine T has its upper portion narrow enough to allow the trigger bar limbs to traverse backwards and forwards and perform all their functions during normal double or single action firing cycles, and to allow the whole trigger bar to be depressed for disconnection. The trigger bar limbs pass rearwardly into rear frame recess A18 where the limbs are connected transversely by means of trigger bar rear limb H4.

As shown in FIGS. 14, 15 and 16, the rear upper frame is perforated transversely by the hammer axis pin hole A11, the sear axis pin hole A12, the main spring axis pin hole A13, and the manual safety unit axis hole A14. The manual safety unit axis hole has a slot A15 cut parallel to the axis at the lowest point of the circumference. The frame at either end of holes A12 and A13 is reduced in width from that of the regular frame and steps SS6 formed on either side inside the grip SS fit adjacent to the ends of the sear axis pin and main spring axis pin, and retain those pins when the grip is fitted to the frame. The whole lockwork is assembled before the grip is fitted. The right safety lever unit HH is inserted into the safety axis hole from the right side of the frame with the safety catch spring KK engaging either tongue KK1 or tongue KK2 in right safety lever unit arbor peripheral groove HH1, and the safety catch spring lying in the slot A15. When the right safety lever unit with safety catch spring are fully inserted in hole A14 the lever HH2 is put vertically down, slightly angled to the rear, and the left safety lever unit JJ is inserted into hole A14 from the left with the lever JJ2 vertically down and angled slightly to the rear. The flat JJ3 will pass over tongue KK1 or tongue KK2, whichever is at the left end of slot A15. The key JJ4 on the unit JJ will engage in slot HH3 cut across the end of the arbor HH4. The whole manual safety can be rotated to have the levers forward, and the safety catch spring left tongue will locate in the left safety lever unit arbor peripheral groove JJ5. When the levers are in the forward horizontal position the detent KK3 on the safety catch spring will engage in the longitudinal hemispherical groove HH3. The safety levers are slightly depressed to allow the insertion of the hammer axis pin EE from either side, into hole A11. On the pin EE are located the hammer J, and a safety detent piece LL on the left. There is clearance on the right of the hammer for an ejector L and a disconnector bar H5, which is an upward extension with a right angled dog leg at the rear of the trigger bar limb H3, as shown in FIG. 9. The sear K is shown in FIG. 9, and is mounted on sear axis pin FF, with the ejector L and ejector spring AB to the right thereof, the ejector spring hook AB1 engaging on ejector hook L2. The sear point K5 rests against the hammer forward surface, engaged in hammer notch J1 with the hammer uncocked. A slot LL1 in a safety detent piece LL engages with a small pin HH6 which protrudes parallel with the axis of the right safety lever unit arbor into the well HH7.

The main spring BB is mounted on main spring pin GG, The upper limbs of the main spring join transversely at the top through a hollow roller BB6, which will bear against the front of surfaces of the hammer tail J2 under spring torsion from coils BB4, and compel the hammer to rotate around its axis pin. The main spring lower limb BB1 coils at its lower extremity and the limb BB2 under spring torsion bears against sear tail K3, forcing the sear nose to bear against the hammer. With the assembly of the rear firing lock complete the grip can be fitted to the frame grip A18, and secured by screwing grip screw TT through hole SS1 into threaded hole A19 in the lower portion A21, of the backstrap A20, which is dished out rearwardly in order to strengthen the backstrap and allow the grip screw to be tightened in hole A19 without obstructing or binding the magazine. A clearance cut SS4 in the grip serves to accommodate the dished out section A21 and the main spring lower limbs. The large radii SS5 at the lower front of the inside panels of the grip are to allow the grip to be tilted when installing or detaching, the safety levers preventing a straight forward or rearward movement under those circumstances.

With the whole firing lock assembled and the pistol complete, it is as shown in FIG. 1 with the firing lock at rest. The trigger and trigger bar are kept forced to the rear by the action of the spring tail Z1 of a hold open spring Z. The whole hold open assembly is shown in FIG. 17. The hold open lever X is held in the frame by axis pin X3 locating in frame hole A4 and pin X1 passing through frame hole A5. The inner hold open member Y fits onto the hold open pins on the inside of the frame, the flange Y1 to the front of the frame. The hold open spring coiled section is fitted over the rebate X2 on pin X3, acting to retain both hold open units together; the right angled tail Z2 is seated underneath the forward section of the inner hold member, as in FIG. 1, with the spring tail Z1 bearing against the bottom forward edge H5 of the left forward transverse arm H6 of the trigger bar. The pressure of the spring tail Z1 against point H5 will tend to pivot the trigger bar around the axis of trigger pin G1, thereby forcing the rear of the trigger bar upwards, bearing the disconnector bar tip H8 up against the under surface of the rear slide, and acting as a trigger bar and trigger return spring.

With the hammer resting against the rear surface B13 of the slide, the sear point K5 is resting in hammer notch J1, and the disconnector bar seats against the hammer axis pin, locating the trigger bar transverse limb H4 behind hammer bent J4. This situation is shown in FIG. 31, and FIG. 6*a*.

The sequence of drawings constituting the whole FIG. 6, *a* to *d*, represents the firing lock action during manual cocking of the hammer, the single action mode of firing. During manual cocking, the hammer spur J6 is forced back and down to pivoit the hammer on its axis pin. The hammer surface J2 will force the main spring upper limbs forward through the main spring roller, torsioning the main spring coils, and the rebated tail J5 will pass between the main spring upper limbs, the width of these not exceeding the maximum width of the hammer. The surface J2 will then impinge on the transverse rear limb of the trigger bar, as in FIG. 6*d*, and position it close to the sear nose K1 rear surface. If the hammer is only rotated to the position shown in FIG. 6*b* the sear point will engage in the hammer half cock notch J3, thus being in a safe position, since the hammer is not able to contact the firing pin. On full rotation of the hammer the hammer bent J4 will lift above the sear nose, allowing the same to move rearwards under the hammer bent until the sear point K5 contacts the hammer surface J7. The hammer is then released to allow the bent to sit on the upper surface of the sear nose, where it will seat under spring pressure. Pressure on the trigger will draw the trigger bar forward to connect with the sear nose, will pull the sear nose away from under the hammer bent and allow the hammer to rotate to hit the firing pin base S2. The contact of the sear point with hammer surface J7 is intended to limit the protrusion of the sear nose under the hammer bent and the space K4 is intended to act as a dirt trap if necessary.

Figure 3:
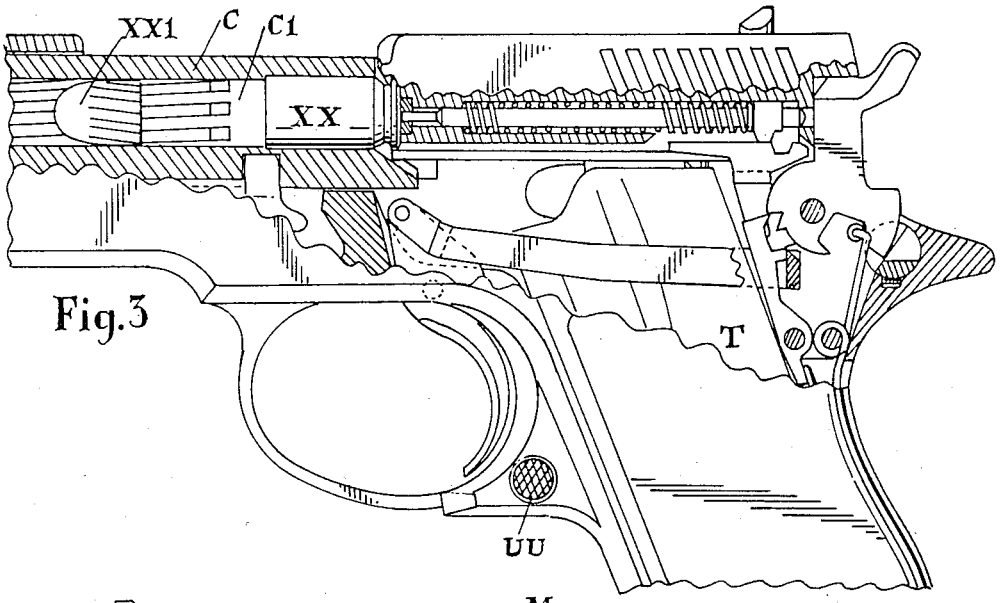
FIG. 3 is a partial view of the pistol, partly in elevation and partly in longitudinal vertical section, showing the sear nose pulled clear of the hammer bent by the trigger bar drawn forward by means of the trigger, the hammer having pivoted to strike the firing pin, thereby discharging the cartridge in the barrel chamber.

FIG. 3 shows the firing pin having been thrown forward by the hammer, the inertia of the firing pin acting against pressure of the firing pin spring to hit the primer of the cartridge XX in the barrel C and fire the cartridge, discharging the bullet XX1 through the barrel bore C1.

Figure 5:
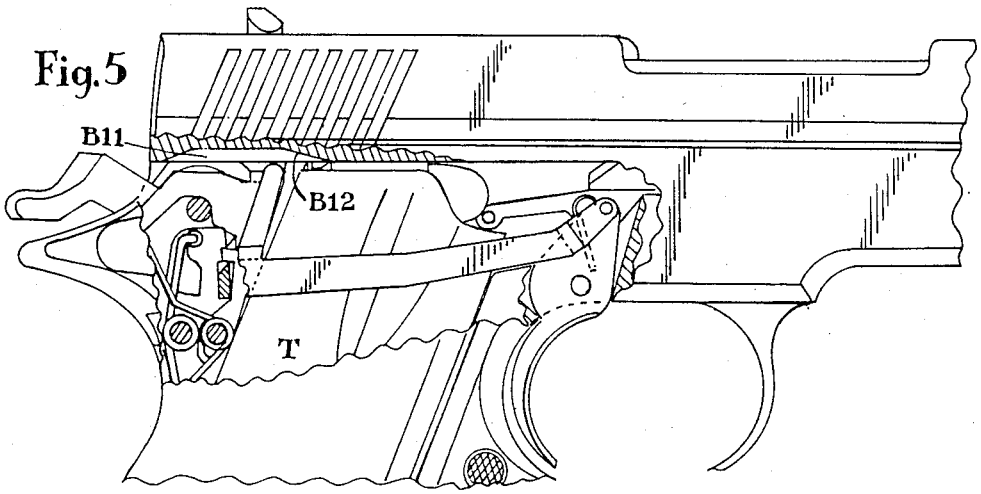
FIG. 5 is a partial view of the pistol, partly in elevation, partly in longitudinal vertical section, showing the slide returned to battery position after recoil, the hammer cocked, pressure on the trigger keeping the trigger bar pulled forward and depressed out of engagement with the sear nose.

FIGS. 7*a* to 7*d* show the sequence of double action firing, whereby with the hammer at rest as in 7*a*, pressure on the trigger will draw the trigger bar forward and impinge the front surface of the trigger bar rear transverse limb against the rear surface of the hammer bent. Further trigger pressure will draw the trigger bar forward, pivoting the hammer as shown in FIGS. 7*b* and 7*c*. When the hammer reaches the position as shown in FIG. 7*d* the trigger bar rear transverse limb upper forward point will slip from under the hammer bent tip. The rear surface of the hammer bent being angled rearwards towards the tip until the hammer is rotated fully back will keep the trigger bar rear limb from sliding off the bent tip until the rear bent surface passes the vertical position and the bent tip rotates above the transit line of the trigger bar rear limb upper point. At the point of release the rear limb will be about to contact the sear nose, thereby preventing the sear dropping into the half cock notch as the hammer clears and pivots under spring pressure. The central part of the upper rear of the trigger bar rear transverse limb is cut away at an angle rearwards and downwards as shown in FIG. 9, the cut away being to allow clear passage for the hammer bent when the hammer pivots. In FIG. 8*a* the cartridge is fired and in FIG. 8*b* the slide is recoililng, the slide rear bottom corner B10 forcing against hammer surface J8 and pivoting the hammer around until the hammer bent pivots above sear surface K6. It will be seen in FIG. 3 that when the slide is forward and locked by locking block E to the barrel, the wing E1 engages in barrel cut C11 and corresponding cuts in the front lower slide wings. When the slide recoils the forward cam surface B12 of the slide recess B11 depresses the disconnector; thereby the trigger bar pivots around trigger pin G1, against the pressure of spring tail Z1, and the trigger bar rear limb is depressed out of line with the sear nose, as in FIGS. 8*b* and 8*c*. FIGS. 49, 50, 51, 52 and 53 show the frame with the relative positions of the firing lock units. FIG. 52 shows the disconnector bar adjacent to the ejector, with the disconnector not depressed. FIG. 30 shows the slide fully to the rear with the hammer bent lifted over the sear nose and the trigger bar depressed. It will be seen in FIG. 8*c* that when the trigger bar rear limb is depressed the sear can be pivoted by the main spring limb BB2 to put the sear nose back in the position to hold the hammer bent when the slide returns forward under spring pressure to its battery position as in FIG. 5. When the slide is forward recess B11 is above the disconnector bar but the underside of the sear nose prevents the trigger bar rear limb from rising. Releasing pressure on the trigger will allow the trigger bar to travel rearwards under pressure from spring Z1, and when the trigger bar rear limb clears from under the sear nose under surface, the disconnector can rise into the slide recess B11 with the trigger bar pivoting around trigger pin G1 under spring pressure. Complete release of the trigger will allow the trigger bar to move rearwards until the rear limb contacts hammer surface J2 resulting in the position as shown in FIG. 2. The pistol is now ready to fire again.

When the last cartridge in the magazine has been used the magazine cartridge follower U will rise and impinge its forward platform U1 on the hold open pin X1, raising the hold open unit, and on the recoil of the slide to eject the last fired cartridge case, or on manual retraction of the slide with an empty magazine in the pistol, the hold open will rise under the magazine spring pressure and the hold open catch lug X4 will engage in slide recess B20 when the slide is fully rearwards. FIG. 39 shows the magazine follower contacting the hold open pin X1, the pin and frame access hole A5 shown in dotted lines. FIG. 10 shows the hold open catch fully down, indicating a loaded magazine in the pistol, FIG. 12 shows the hold open catch forced up by the magazine follower, as in FIG. 39, this position indicating to the user that an empty magazine is in the pistol, and FIG. 13 shows the hold open catch engaged with the retracted slide. Only in the position as in FIG. 13 will the hold open inner flange Y1 be pivoted down from being engaged before the trigger guard pin D8, and allow the whole trigger guard D to be moved forward and down to the position shown in FIG. 30. The trigger axis pin can be pushed out from either side with the trigger guard down, and the trigger and trigger bar lifted upwards.

The manual safety catch can be applied with the hammer at rest or at full cock. The right or left safety lever is pushed upwards from the rest position shown in FIG. 10 to the position as in FIG. 11. The detent pimple KK3 on the safety catch spring seats in groove HH9 with the safety catch raised, to prevent the return of the safety unit to the rest position without definite pressure on one or both of the safety catch levers.

The centre portion of the right safety arbor is cut away to produce well HH7 with a flat HH10 and another cut away at an angle to produce a flat edge HH11 to the front of flat HH10 and the surface HH12 at the right end of the well HH7. FIG. 38 shows the safety catch unit at rest, with the flat HH10 parallel to the barrel axis and the flat HH11 clear of the rear surface of the hammer J9. When the safety catch arbor is rotated by an upward motion of the safety levers the front of the flat HH10 will move under the lower section of surface J2 on the hammer, thereby blocking rotation of the hammer. The pin HH6 will rotate with the arbor and being engaged in the notch LL1 of the safety detent piece will tend to rotate the piece around the axis of the hammer pin passing through hole LL2, and the detent arm LL4 will impinge on trigger bar limb H2 and depress the rear of the trigger bar, as shown in FIG. 39.

The detent piece bar LL3 wil move down before the front upper sear face K7 thereby blocking forward motion of the upper sear, and locking sear point K5 into hammer notch J1. In the safety state as herein before described the hammer cannot be cocked manually, or by trigger pressure through the trigger bar, which will pass below the hammer bent if moved foward. The blocked hammer will prevent the slide from being drawn rearwards.

When the hammer is cocked as in FIG. 40 and FIG. 11, application of the manual safety, moving the safety levers upwards will rotate the arbor, and the lower peripheral surface HH12 will move over hammer ledge J8, thereby blocking rotation of the hammer. The safety detent piece will rotate, with the pin HH6 engaged in safety detent piece notch LL1, and the detent arm LL4 will depress the rear of the trigger bar, preventing it contacting the sear nose if the trigger is pulled. The transverse detent bar LL3 will depress and block the sear nose from moving out of contact with the hammer bent. FIG. 40 shows this safety position, and while it will be observed the hammer is positively prevented from being released to impinge on the firing pin, the slide can be cycled if so wished. While the manual safety is being released when the hammer is cocked, the trigger bar rear limb being depressed by the safety detent piece will have placed the limb below the position of contacting the sear nose, so pressure on the trigger during release of the manual safety cannot cause the sear to be pivot forward, and release the hammer. This is a safety aspect of the manual safety system.

A magazine safety system, in which the partial or complete removal of the magazine from the magazine well of the pistol renders the firing lock inoperable, has advantages and disadvantages, so it is proposed to have a magazine safety unit that is easily and quickly removed from the pistol, or replaced. Two types of magazine safety units are herewithin described, that could be fitted to a pistol or other fire arm. FIGS. 31, 32 and 33 shows one type of magazine safety as fitted to the pistol hereinbefore described. The trigger is shown in FIG. 33 with a vertical longitudinal slot cut from the upper part of the trigger and having a concave lower surface passing below the trigger pin hole, allowing clearance when the coils ZA1 of the spring ZA are accommodated on the trigger axis pin. With the magazine fully home the magazine lip T3 will impinge on and force upwards limb ZA2 of spring ZA. The forward limb ZA3 impinges on the forward surface D9 of the trigger well D8 of trigger guard D. The partial or complete withdrawal of the magazine will allow spring arm ZA2 to rotate rearwardly and downwards and impinge a transverse spring limb ZA4 against the upper surface of trigger bar limb H3. The torsional strength of spring ZA will overcome the resistance of trigger bar spring Z1, and depress the trigger bar, placing the rear trigger bar limb below the level of the hammer bent and sear nose, as in FIG. 32. FIG. 31 shows the position of the magazine safety spring ZA, and limb ZA2 tending to exert a downwards thrust to the magazine, thus being an aid to the expulsion of the magazine when the magazine catch is activated.

An alternative magazine safety system is shown in FIGS. 44 to 48 inclusive. A circular hole A25 penetrates transversely the right side of the frame ahead of the right safety lever. To the rear of the hole the frame wall is rebated to half the frame wall thickness, or to a depth to accommodate the thickness of the appropriate spring. The rebate is the height of hole A25 and the rebate terminates in a circular form to the frame rear, as in FIG. 46. The right side of the grip is shaped to cover the complete rebate A26 and the hole A25; the bold line SS7 in FIGS. 44 and 46 shows the extremity of the grip edges. In FIG. 45, the dotted line shows the extremitiy of the grip. A spring ZZ, as shown in FIG. 46, is fitted into the recess A26 with its upper limb ZZ2 seated against the upper edge of the recess. The right angled arm ZZ1 protrudes through the hole A25 into the frame interior. When the magazine is installed in the pistol with the nose VV1 of the magazine catch VV engaged in notch T1 of the magazine T, as shown in FIG. 1, the end of arm ZZ1 engages with and is lifted by the magazine lip T3, thereby being lifted above the level of the upper surface of trigger bar limb A3, and allowing clear passage of the trigger bar during the firing cycle. When the magazine is displaced downwards by the release of the magazine catch plunger UU, the arm ZZ1 will move downwards under torsion from the spring section ZZ3. The spring arm ZZ1 will impinge immediately on the upper surface of trigger bar limb H3 and the pressure of the spring ZZ will overcome the pressure of the trigger bar spring Z1 thereby forcing the trigger bar to rotate downwards around the axis of trigger pin G1. FIG. 45 shows the position of the trigger bar with the magazine partially withdrawn and the magazine safety spring forcing the trigger bar rear limb below the level of the sear nose and hammer bent.

In certain conditions it can be hazardous to ease the hammer down manually from the cocked position to the rest position; if the hammer spur were to slip from under the thumb during the early part of the operation the impact of the hammer on the firing pin could discharge a cartridge in the barrel chamber, without the user intending such, and the recoiling slide could injure the user's hand, or other part of the anatomy, and the accidentally dischargedbullet could cause injury to the user, other parties, or propety. The safety catch of the present invention allows safe decocking of the hammer under such conditions, as will now be described.

Figure 4:
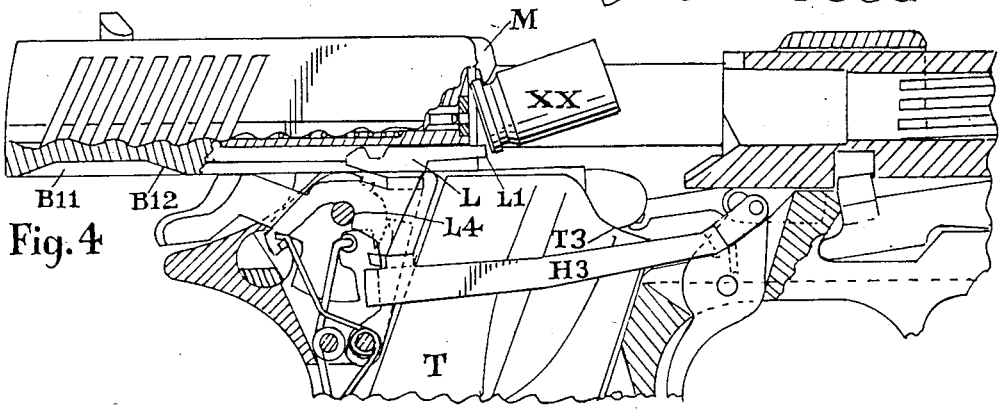
FIG. 4 is a partial view of the pistol, partly in elevation and partly in longitudinal vertical section, showing the slide and barrel unlocked after discharge, the slide partially recoiled, the empty cartridge case held by the extractor striking the ejector, the hammer cocked by the slide, the trigger bar depressed.

FIG. 41 shows the pistol rear section with the hammer cocked and the safety catch in the rest position as shown in FIG. 41*a*. The ejector L has an elongated hole L3 through which passes the sear axis pin, and also the coil of the ejector spring AB on the sear axis pin, the hook AB1 at one end of the spring AB, engaging with ejector hook L2, forcing the ejector down and rearwardly. The surface L4 bears against the hammer axis pin and will act as a stop when the extracted cartridge case is pulled by the extractor M rearwardly to hit the ejector nose L1 to pivot the cartridge case and eject it from the pistol, as in FIG. 4. The sear pin K7 sits in the recess L6 in the ejector. When the safety levers are forced down as in FIGS. 42 and 42*a*, the arbor rotates anticlockwise viewed from the left, the arbor pin HH6, engaged in detent piece slot LL1 will rotate the detent piece, and the detent bar LL3 will raise and impinge on the under surface of the rightangled part L8 of the ejector. This will force the ejector upwardly against the tension of the ejector spring, and engage cutout L5 of the ejector with the base of the firing pin boss S1. When the cutout L5 is engaged with boss S1 the arbor pin will tend not to pivot the detent piece as quickly, tending to rotate out of the slot LL1. At this point surface HH12 of the rotating arbor will contact the rear surface L7 of the ejector leg L9 and tend to force the ejector to rotate around the axis of sear axis pin FF, as in FIG. 43. The rotating lifted ejector, with the cut out L5 engaged with the firing pin boss, will push the firing pin forward against the tension of firing pin spring and the ejector spring. When the firing pin is safely withdrawn into the slide with the firing pin end S2 below the surface B13 of the slide, the ejector cutout L6 rear surface bearing against sear pin K7 will exert a forward motion to the sear top and thus the sear nose. The sear nose will move from under the hammer bent and allow the hammer to rotate under main spring BB, to hit the slide surface B13. As the firing pin is at this moment withdrawn inside the slide by the ejector the hammer impact cannot discharge a chambered cartridge. The final position of the decocking procedure is shown in FIG. 43*a*, with the safety levers fully depressed. Return of the safety levers to the rest position as in FIG. 10 will rotate the detent piece, allow the ejector to move downwards and rearwards under spring pressure from spring AB, and the firing pin will be released and return to its position as in FIG. 1, with clear passage rearwards and forwards. If necessary, additional means such as spring pressure could be applied to the safety lever unit to prevent the safety levers being depressed too easily, and thus decocking the firearm unintentionally.

If it is found necessary to have a stop to prevent further forward movement of the trigger bar after disconnection, a stop can be fitted to the forward upper or lower rear faces of the trigger, or a stop could be fitted to the forward vertical surface of the trigger guard well, or a stop could be fitted to the trigger guard unit behind the lower portion of the trigger. Alternatively, another suitable manner could be used to prevent further rearward motion of the lower trigger. Alternatively, another suitable manner could be used to prevent further rearward motion of the lower trigger after full release of the sear from the hammer.

The application of the invention to other small arms differs in no essential respect from its application to pistols of the type hereinbefore described.

The terms "horizontal" and "vertical" as used herein refer to the pistol or other fire arm when held in the normal firing position.

I claim:

1. A fire arm of the self loading pistol type having a reciprocating slide carrying an inertia-operated firing pin, a firing lock comprising a hammer, sear, trigger, trigger bar, ejector and main spring, and a safety catch comprising an arbor rotatably mounted in the frame of the fire arm, and manual lever means located on the outside of the frame for rotating said arbor in either direction from a rest or off position in which the fire arm can be operated, said arbor being rotatable in one direction to an end position in which the hammer in either the cocked or uncocked position is locked against rotation by respective engagement means on the arbor, and said arbor also being rotatable in the other direction to move a detent member pivotally mounted in said frame to move the ejector upwardly and forwardly to engage said firing pin and to withdraw its striking end, against which the hammer strikes in operation of the fire arm, completely into the slide, and thereafter to release the hammer from cocking engagement with said sear, whereby said hammer is returned to the uncocked position without danger of discharging a live cartridge in the breech of the fire arm.

2. A fire arm as claimed in claim 1, wherein, during movement of the arbor to said end position in which said hammer is locked against rotation, said detent is rotated by said arbor to depress and hold said trigger bar in a position in which movement of the trigger will not move the sear to release the hammer.

3. A fire arm as claimed in claim 1, wherein said detent is coupled to said arbor by means of a recess in the detent engaging a pin on said arbor.

4. A fire arm as claimed in claim 1, wherein said ejector has a recess in the upper surface thereof which engages a downwardly projecting part of a rear boss on said firing pin to hold said firing pin on upward movement of said ejector under the action of said detent.

5. A fire arm as claimed in claim 1, wherein said main spring is formed as a single unit from spring wire having a central coiled portion for mounting on a pivot pin in the frame, any upper limb portion bearing against the hammer and urging it to rotate towards said firing pin, and a lower limb portion bearing against the sear to urge the sear nose to bear against the hammer.

6. A fire arm as claimed in claim 1, wherein said trigger bar is attached to the trigger by means of two arms located at the front thereof having apertures therein which are sprung over the protruding ends of a transverse pin on the upper part of said trigger above the trigger pivot point.

7. A fire arm as claimed in claim 1, wherein a magazine safety system acting to render the firing lock inoperable on removal of the magazine from the magazine well of the fire arm.

8. A fire arm as claimed in claim 1, wherein said arbor is formed in two parts, each having a respective manual lever at one end thereof, said parts being connected together at their ends remote from said levers by at least one projection on one said part engaging at least one corresponding recess in the other said part and spring loaded towards one another.

9. A fire arm as claimed in claim 8, wherein said spring loading is provided by a spring located in a recess in the frame below said arbor and having upstanding ends engaging in respective peripheral grooves in said two parts of the arbor.

10. A fire arm as claimed in claim 9, wherein said spring has a central protuberance adapted to resiliently engage in a respective longitudinal groove in said arbor when said safety catch is in the rest or said one end position.

* * * * *